US009818387B2

(12) United States Patent
Dejima

(10) Patent No.: US 9,818,387 B2
(45) Date of Patent: Nov. 14, 2017

(54) ELECTRONIC STRINGED MUSICAL INSTRUMENT, MUSICAL SOUND GENERATION INSTRUCTION METHOD AND STORAGE MEDIUM

(71) Applicant: CASIO COMPUTER CO., LTD., Shibuya-ku, Tokyo (JP)

(72) Inventor: Tatsuya Dejima, Hamura (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 3 days.

(21) Appl. No.: 15/256,514

(22) Filed: Sep. 3, 2016

(65) Prior Publication Data

US 2017/0076704 A1 Mar. 16, 2017

(30) Foreign Application Priority Data

Sep. 15, 2015 (JP) ..... 2015-181329

(51) Int. Cl.
*G10H 1/18* (2006.01)
*G10H 1/34* (2006.01)
*G10H 3/12* (2006.01)

(52) U.S. Cl.
CPC ..... *G10H 1/342* (2013.01); *G10H 1/18* (2013.01); *G10H 3/125* (2013.01); *G10H 2220/191* (2013.01); *G10H 2220/301* (2013.01); *G10H 2220/425* (2013.01)

(58) Field of Classification Search
CPC ..... G10H 1/18
USPC ..... 84/615
See application file for complete search history.

(56) References Cited

U.S. PATENT DOCUMENTS 7,301,481 B2 * 11/2007 Okada ..... G09B 13/04 341/20
7,485,794 B2 * 2/2009 Koizumi ..... G10H 1/0083 84/477 R
7,646,374 B2 * 1/2010 Dickson ..... A63B 69/004 345/168
7,848,699 B2 * 12/2010 Ohshima ..... G09B 5/00 434/307 R (Continued)

FOREIGN PATENT DOCUMENTS

JP 2014134600 A 7/2014

*Primary Examiner* — David Warren
(74) *Attorney, Agent, or Firm* — Holtz, Holtz & Volek PC

(57) ABSTRACT

An electronic stringed musical instrument is provided which is capable of performing string-pressing detection while maintain a neck strength without lowering reliability. Here, Radio-Frequency Identification (RFID) tags where wiring is not necessary are arranged between frets for each of the first to sixth strings, whereby its neck strength is maintained. When a string comes close to an RFID tag in response to a string-pressing operation, the RFID tag wirelessly transmits first identification information including at least its own "fret number (string-pressed point)" using electrical power acquired by receiving a radio wave transmitted from the string that functions as an antenna. Then, this information is received and demodulated via the string that functions as an antenna. That is, the string-pressed point is detected by non-contact detection, so that string-pressing detection can be performed without lowering reliability.

13 Claims, 16 Drawing Sheets

(56) References Cited

U.S. PATENT DOCUMENTS

| | | | | |
|---|---|---|---|---|
| 7,859,409 | B2 * | 12/2010 | Sakurada | G06K 17/0022 235/380 |
| 8,884,150 | B2 * | 11/2014 | Swanson | G10H 3/24 84/723 |
| 9,076,264 | B1 * | 7/2015 | Gillespie | G06T 11/206 |
| 9,093,059 | B2 | 7/2015 | Dejima et al. | |
| 9,142,200 | B2 * | 9/2015 | Park | G10H 7/002 |
| 2007/0183829 | A1 * | 8/2007 | Dickson | A63B 69/004 400/273 |
| 2007/0234883 | A1 * | 10/2007 | Koizumi | G10H 1/0083 84/615 |
| 2010/0018381 | A1 * | 1/2010 | Ohshima | G09B 7/00 84/470 R |
| 2010/0313736 | A1 * | 12/2010 | Lenz | G09B 15/02 84/477 R |
| 2014/0033904 | A1 * | 2/2014 | Swanson | G10H 3/24 84/723 |
| 2015/0024799 | A1 * | 1/2015 | Swanson | H04R 1/46 455/550.1 |
| 2015/0068392 | A1 * | 3/2015 | Huston | G10H 3/143 84/726 |
| 2015/0242018 | A1 * | 8/2015 | Shi | G06F 3/044 345/174 |
| 2015/0255053 | A1 * | 9/2015 | Nelson | G10H 1/0066 84/645 |
| 2016/0071430 | A1 * | 3/2016 | Claps | G09B 15/023 84/485 R |
| 2016/0210949 | A1 * | 7/2016 | Kang | G10H 1/183 |

* cited by examiner

ELECTRONIC STRINGED MUSICAL INSTRUMENT, MUSICAL SOUND GENERATION INSTRUCTION METHOD AND STORAGE MEDIUM

CROSS-REFERENCE TO RELATED APPLICATION

This application is based upon and claims the benefit of priority from the prior Japanese Patent Application No 2015-181329, filed Sep. 15, 2015, the entire contents of which are incorporated herein by reference.

BACKGROUND OF THE INVENTION

1. Field of the Invention

The present invention relates to an electronic stringed musical instrument, a musical sound generation instruction method and a storage medium which are capable of performing string-pressing detection while maintaining neck strength without lowering reliability.

2. Description of the Related Art

Conventionally, an electronic stringed musical instrument provided with a string-pressing sensor is known. For example, Japanese Patent Application Laid-Open (Kokai) Publication No. 2014-134600 discloses an electronic wind instrument that detects, by a string-pressing sensor, which fret/string has been pressed by the left hand of a player, detects, by a string-plunking sensor, which string of a plurality of strings has been plunked, and adjusts the musical sound of a pitch at which sound emission is performed in accordance with a state detected by the string-pressing sensor, based on the vibration pitch of a string detected by the string-plunking sensor.

However, the technique disclosed in Japanese Patent Application Laid-Open (Kokai) Publication No. 2014-134600 has the following adverse effects.

(a) In a type where string-pressing detection is performed using an electrical contact between a string and a fret, a contact failure may occur, which lowers the reliability of the detection operation.

(b) In a type where string-pressing detection is performed with an electrostatic sensor provided for each fret, a number of wirings are necessary for a fingerboard, and therefore an area occupied by a wiring board increases, whereby the neck strength cannot be maintained.

The present invention has been conceived in light of the above-described problems. An object of the present invention is to provide an electronic stringed musical instrument, a musical sound generation instruction method and a storage medium which are capable of performing string-pressing detection while maintaining a neck strength without lowering reliability.

SUMMARY OF THE INVENTION

In accordance with one aspect of the present invention, there is provided an electronic stringed musical instrument comprising: a plurality of strings which is tighten above a fingerboard section provided with a plurality of frets; a plurality of Radio-Frequency Identification (RFID) tags each of which is arranged between frets; a string-plunking detection section which detects plunked states of the plurality of strings; and a processing section which performs sound emission instruction processing for instructing a sound source to emit a musical sound of a pitch determined based on first identification information transmitted from an RFID tag and second identification information including information regarding the plunked states of the plurality of strings detected by the string-plunking detection section, wherein the first identification information includes information regarding a pressed state of a string.

In accordance with another aspect of the present invention, there is provided a musical sound generation instruction method for an electronic stringed musical instrument having a plurality of strings which is tighten above a fingerboard section provided with a plurality of frets, a plurality of Radio-Frequency Identification (RFID) tags each of which is arranged between frets, a string-plunking detection section which detects plunked states of the plurality of strings, and a processing section, wherein the processing section instructs a sound source to emit a musical sound of a pitch determined based on first identification information transmitted from an RFID tag and second identification information including information regarding plunked states of the plurality of strings detected by the string-plunking detection section.

In accordance with another aspect of the present invention, there is provided a non-transitory computer-readable storage medium having stored thereon a program that is executable by a computer in an electronic stringed musical instrument having a plurality of strings which is tighten above a fingerboard section provided with a plurality of frets, a plurality of Radio-Frequency Identification (RFID) tags each of which is arranged between frets, and a string-plunking detection section which detects plunked states of the plurality of strings the program being executable by the computer to actualize functions comprising: instructing a sound source to emit a musical sound of a pitch determined based on first identification information transmitted from an RFID tag and second identification information including information regarding plunked states of the plurality of strings detected by the string-plunking detection section.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

BRIEF DESCRIPTION OF THE DRAWINGS

The present invention can be more deeply understood by the detailed description below being considered together with the following drawings.

DETAILED DESCRIPTION OF THE PREFERRED EMBODIMENTS

An embodiment of the present invention will hereinafter be described with reference to the drawings.

A. External Appearance

Figure 1:
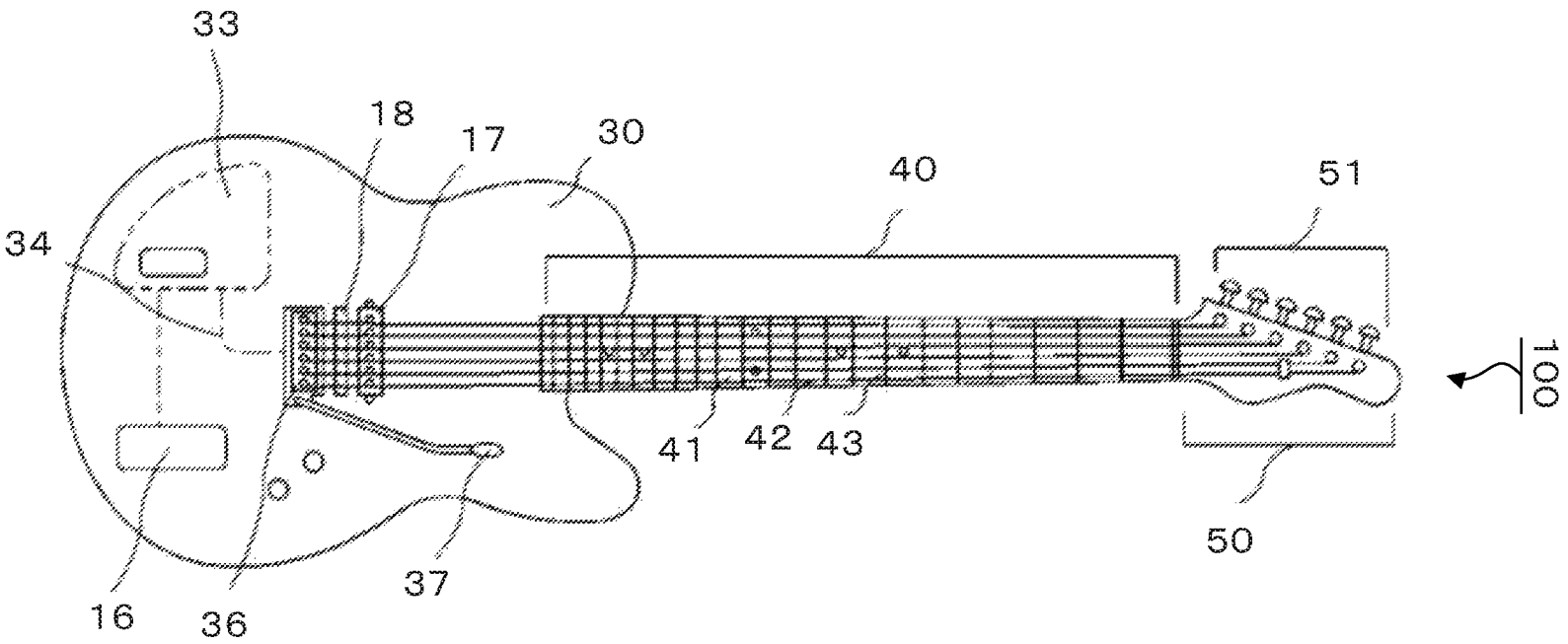
FIG. 1 is an external view showing the external appearance of an electronic stringed musical instrument 100 according to an embodiment of the present invention.

FIG. 1 is an external view showing the external appearance of an electronic stringed musical instrument 100 according to an embodiment of the present invention. This electronic stringed musical instrument 100 in FIG. 1 has a shape similar to that of a guitar, and is constituted by a main body 30, a neck portion 40 and a head portion 50. In the head portion 50, a string winding portion 51 is provided around which one end portion of each steel string 42 (the first string to the sixth string) is wrapped. Note that each of the steel strings 42 (the first string to the sixth string) functions also as a transmitting/receiving antenna described later.

The neck portion 40 has a plurality of frets 43 mounted on a fingerboard 41, and fret numbers are provided on intervals of the frets 43 in order from the head portion 50 side. The main body 30 is provided with a normal pickup 17 which detects vibrations of strings 42, a hexaphonic pickup 18 which detects the vibration of each string 42 individually, an electronic portion 33 which is built-in in the main body 30, a cable 34 which supplies outputs of the above-described pickups 17 and 18 to the electronic section 33, a display section 16 which displays a configuration state and an operation state of the electronic stringed musical instrument, a bridge 36 to which the other end of each string 42 (the first string to the sixth string) is attached, and a tremolo arm 37 which is operated when the tremolo effect is given.

Figure 2:
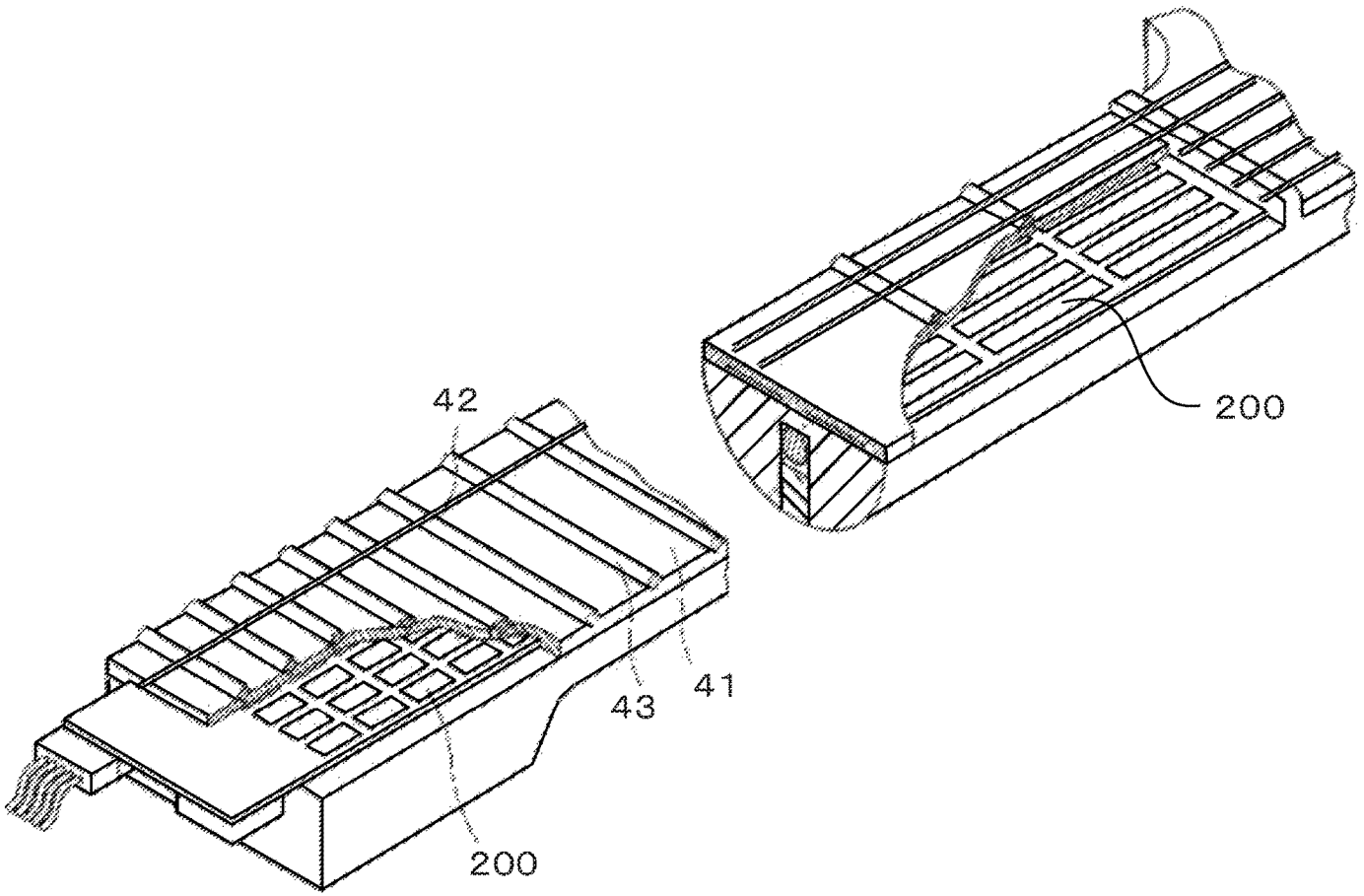
FIG. 2 is an external appearance perspective view showing RFID tags 200 arranged between frets on a neck portion 40.
Figure 4A:
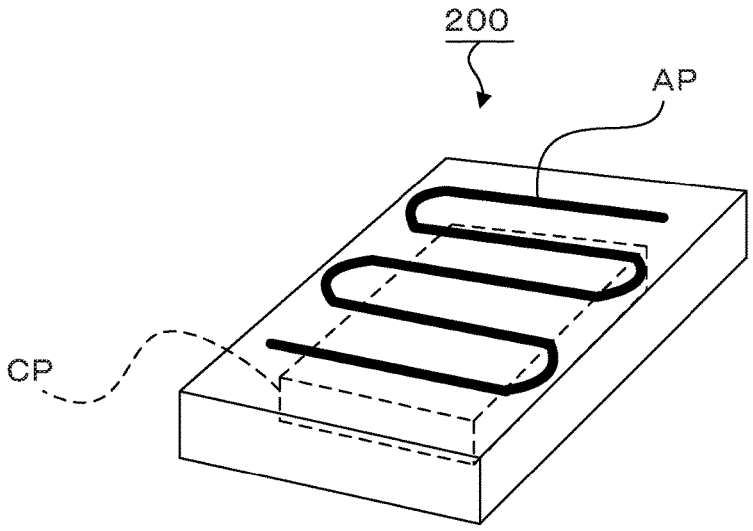
FIG. 4A is an external view showing the outline of an RFID tag 200 and FIG. 4B is a block diagram showing the configuration of a string input/output section 20.

Next, Radio-Frequency Identification (RFID) tags 200 which are arranged on the backface of the fingerboard 41 in the neck portion 40 are described with reference to FIG. 2. Each RFID tag 200 is a tag that is used for a technology of transmitting information via a wireless communication, and also referred to as an IC chip or an IC tag. On the back surface of the fingerboard 41 in the neck portion 40, these RFID tags 200 are provided so as to be arranged between frets 43 for each string 42 (the first string to the sixth string). Each RFID tag 200 is a publicly known RFID and has a housing integrally formed by resin-sealing a built-in chip CP including a CPU (Central Processing Unit) and a wireless transmission/reception section, and an antenna pattern AP formed on the housing surface side opposed to the string 42, as shown in FIG. 4A. The antenna pattern AP is electrically connected to the built-in chip CP.

Each RFID tag 200 performs data transmission by a publicly known radio wave type passive system. That is, when a string 42 is bent by a user's string-pressing operation and comes close to the RFID tag 200, the built-in chip CF is activated by electrical power acquired by receiving a radio wave transmitted from the string 42 that functions as an antenna, and transmits data (on-data described later) including "string-pressing flag", "received radio wave intensity" and "fret number" indicating the string-pressed point. The data wirelessly transmitted from the RFID tag 200 is information regarding a string-pressed state which serves as first identification information, and is received by the main body 30 (electronic section 33) side by the pressed string 42 functioning as an antenna. Details of RFID tag processing to be executed by the RFID tags 200 will be described later.

B. Configuration

Figure 3:
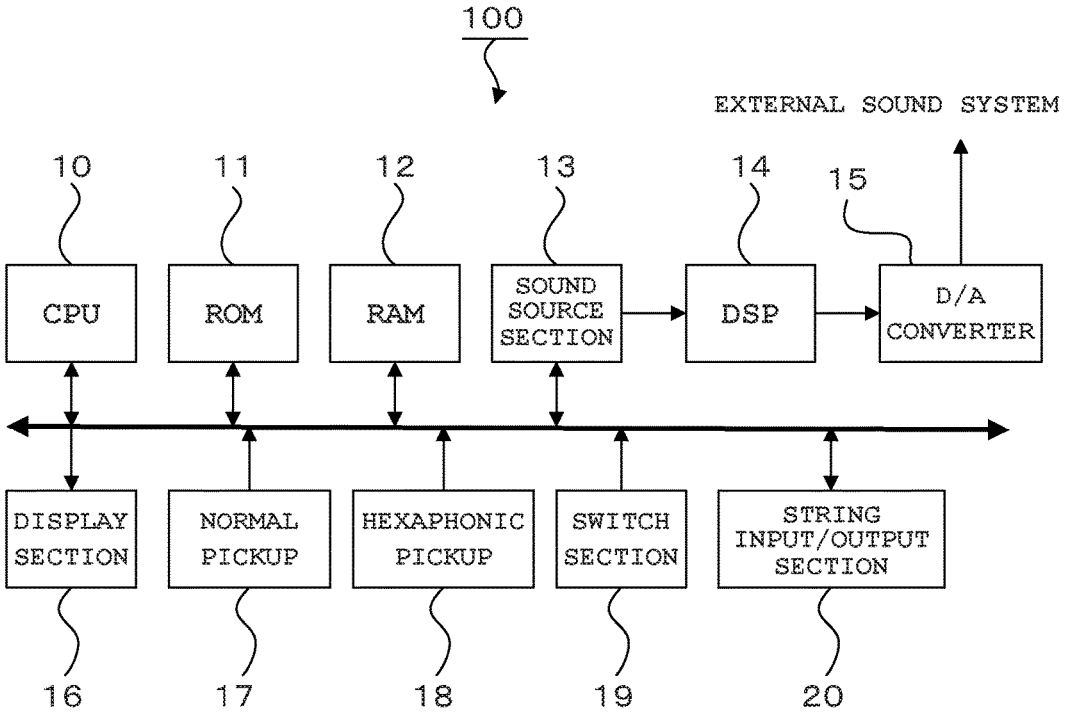
FIG. 3 is a block diagram showing the electrical configuration of the electronic stringed musical instrument 100.

FIG. 3 is a block diagram showing, the electrical configuration of the electronic stringed musical instrument 100 (electronic section 33). A CPU 10 in FIG. 3 executes various programs stored in a ROM 11 to control each section of the musical instrument. Note that the characteristic processing operation of the CPU 10 related to the gist of the present invention will be described in detail further below.

The ROM 11 stores various programs loaded in the CPU 10. These programs include the main flow described later, switch processing and musical performance detection processing which are called from the main flow. Note that the switch processing includes tone switch processing and mode switch processing. The musical performance detection processing includes string-pressed point detection processing, string-plunking detection processing and integration processing. The string-pressed point detection processing includes string-pressing detection processing and preceding trigger processing. The string-plunking detection processing includes normal trigger processing, pitch extraction processing and muting detection processing. The preceding trigger processing includes preceding trigger propriety determination processing.

A RAM 12 in FIG. 3 is provided with a work area and a data area. In the work area of the RAM 12, various registers and flag data which are used for processing by the CPU 10 are temporarily stored. In the data area of the RAM 12, each output of the normal pickup 17, the hexaphonic pickup 18 and a string input/output section 20 described later is temporarily stored. A sound source section 13 in FIG. 3 is provided with a plurality of emitting sound channels constituted by a well-known waveform memory reading system, and generates musical sound waveform data W in accordance with a note-on/note-off event supplied from the CPU 10.

Under control by the CPU 10, a DSP (Digital Signal Processor) 14 performs an waveform operation to the musical sound waveform data W outputted from the sound source section 13 of the preceding stage, and thereby adds an effect such as a tremolo effect. A D/A converter 15 in FIG. 3 converts the musical sound waveform data W with the effect added by the DSP 14 into a musical sound signal of an analog format, which is outputted to an external sound system. Note that, although not shown, the external sound system amplifies a musical sound signal outputted from the D/A converter 15, applies filtering thereto to remove unnecessary noises, and emits it from a loudspeaker as a musical sound.

The display section 16 displays, for example, a musical instrument configuration state or an operation state in accordance with a display control signal supplied from the CPU 10. The normal pickup 17 detects vibrations of plunked strings 42, and performs A/D conversion thereon to generate vibration data. The vibration data is temporarily stored in a data area of the RAM 12 under control by the CPU 10. The hexaphonic pickup 18 detects a vibration of each of the strings 42 (the first string to the sixth string) individually, and performs A/P conversion thereon to generate vibration data for each string. The vibration data for each string is temporarily stored in a data area of the RAM 12 under control by the CPU 10.

The switch section 19 includes, for example, an electric power switch for turning on or off the power, a tone switch for selecting a tone of an emitted musical sound and a mode switch for switching an operation mode, and generates a switch event in accordance with the type of a switch operated by a user. This switch event is loaded into the CPU 10.

Figure 4B:
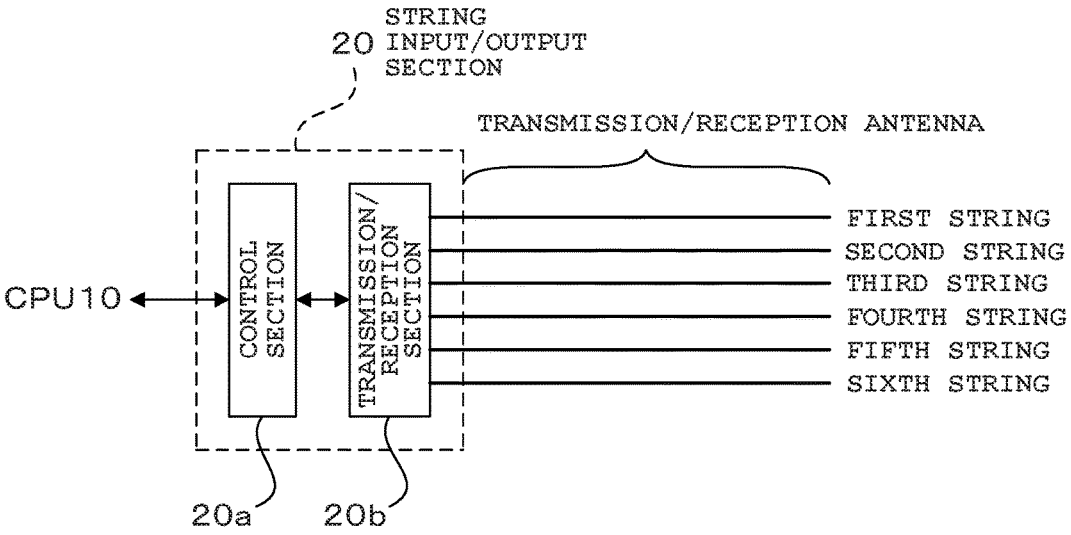

The string input/output section 20 is constituted by a control section 20*a* and a transmission/reception section 20*b* as shown in FIG. 4B. The control section 20*a* gives a transmission instruction and a receiving instruction to the transmission/reception section 20*b* under control by the CPU 10. The transmission/reception section 20*b* is electrically connected to one end of each string 42 (the first string to the sixth string) which functions as a transmitting/receiving antenna.

The transmission/reception section 20*b* supplies a transmission signal (RF signal) to a string 42 specified by a transmission instruction from the control section 20*a* to carry out radio wave transmission. Also, the transmission/reception section 20*b* receives an RF signal having a frequency different from the above-described transmission signal from the string 42 specified by the receiving instruction from the control section 20*a*, and performs demodulation thereon. Then, the transmission/reception section 20*b* outputs the received and demodulated signal to the control section 20*a* as transmission data from an RFID tag 200. The control section 20*a* stores the transmission data received from the transmission/reception section 20*b* in the data area of the RAM 12 under control by the CPU 10.

C. Operation

Next, each operation in the main flow that is executed by the CPU 10 of the electronic stringed musical instrument 100 having the above-described configuration, and each operation in the switch processing and the musical performance detection processing which are called from the main flow are described with reference to FIG. 5 to FIG. 14. Then, an operation of the RFID tag processing that is executed by the RFID tags 200 is described with reference to FIG. 15 to FIG. 16.

(1) Operation of Main Routine

Figure 5:
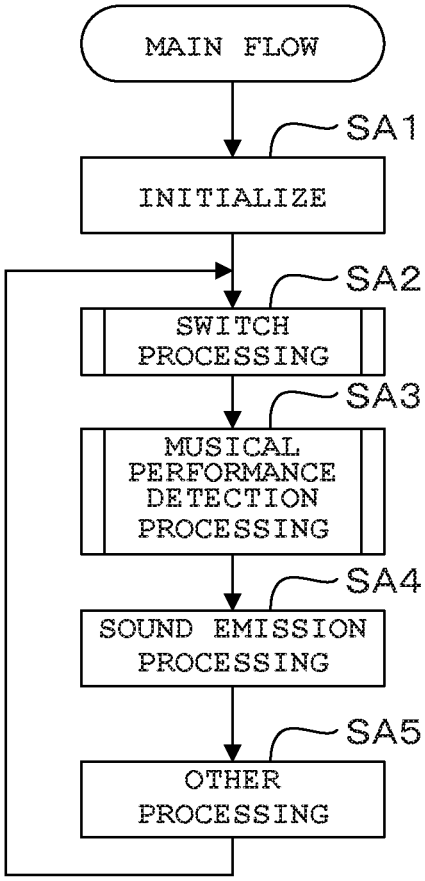
FIG. 5 is a flowchart of an operation in the main flow which is executed by a CPU 10.

FIG. 5 is a flowchart of an operation in the main flow that is executed the CPU 10. When the electronic stringed musical instrument 100 is powered on in response to an operation on the electric power switch, the CPU 10 proceeds to Step SA1 of the main flow shown in FIG. 5, and executes initialization to initialize each section. Then, at subsequent Step SA2, the CPU 10 executes the switch processing. In the switch processing, the CPU 10 gives an instruction regarding a tone number selected in accordance with a tone switching operation to the sound source section 13 and changes the current mode to an operation mode specified by a mode switching operation as described later.

Subsequently, at Step SA3, the CPU 10 executes the musical performance detection processing. As described later, in the musical performance detection processing, when the CPU 10 receives on-data as first identification information transmitted from an RFID tag 200 to acquire a string-pressed point, and a vibration level of each string 42 (the first string to the sixth string) detected by the hexaphonic pickup 18 becomes a certain level or more, the CPU 10 instructs the sound source section 13 to emit (precedence sound emission) a musical sound having a specified tone at a pitch in accordance with the acquired string-pressed point at a velocity (sound volume) calculated based on the detected vibration level. The information of this vibration level is information regarding a plunking state which is second identification information. That is, the CPU 10 instructs the sound source section 13 to emit a sound based on the first identification information and the second identification information.

When the vibration level of each string 42 (the first string to the sixth string) acquired based on an output of the hexaphonic pickup 18 is larger than a threshold value Th2, the CPU 10 turns on a normal trigger flag and, at the same time, extracts the pitch of the string vibration. On the other hand, when sound emission has already been performed, if the vibration level of each string 42 (the first string to the sixth string) is smaller than a threshold value Th3, the CPU 10 turns on a sound muting flag.

Furthermore, when the preceding sound emission has been performed, the CPU 10 adjusts the pitch of the musical sound for which the preceding sound emission has been performed based on a pitch (sound pitch) extracted from a string vibration. In addition, if the sound muting flag is on, the CPU 10 instructs the sound source section 13 to mute the sound. Conversely, when there is no preceding sound emission, if the normal trigger flag is turned on, the CPU 10 instructs the sound source section 13 to emit (precedence sound emission) a musical sound having a specified tone at a pitch in accordance with a string-pressed point serving as acquired first identification information at a velocity (sound volume) calculated based on a vibration level serving as second identification information.

Next, at Step SA4, the CPU 10 performs sound emission processing for outputting the musical sound emitted by the sound source section 13 to the external sound system. At subsequent Step SA5, the CPU 10 executes other processing such as processing for displaying a musical instrument configuration state and an operation state in accordance with the user's switching operation on the display section 16. Hereafter, the CPU 10 repeatedly executes the above-described processing of SA2 to Step SA5 until the power is turned off by an operation on the electric power switch.

(2) Operation in Switch Processing

Figure 6A:
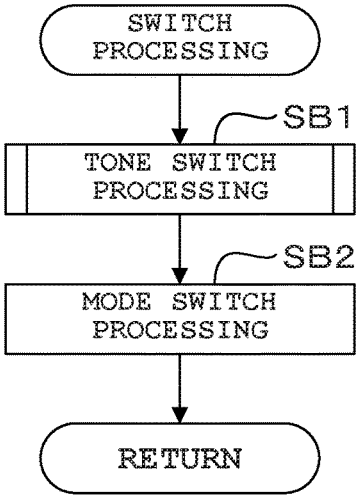
FIG. 6A and FIG. 6B are flowcharts showing an operation of switch processing and an operation of tone switch processing which are executed by the CPU 10.
Figure 6B:
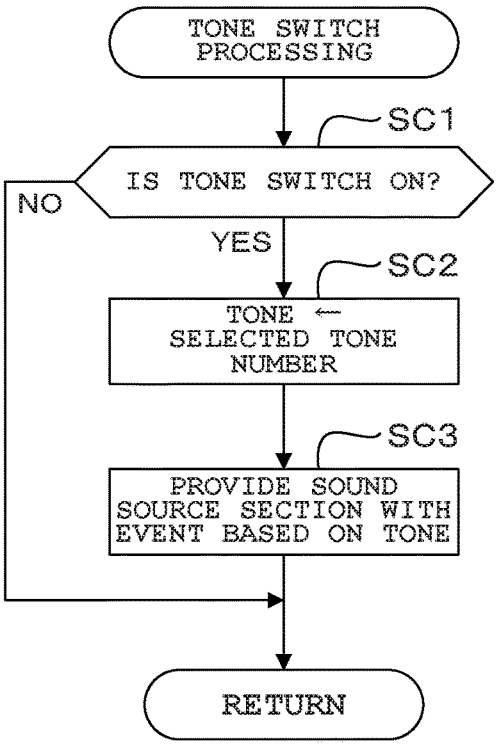

Next, an operation in the switch processing is described with reference to FIG. 6. FIG. 6A is a flowchart showing an operation in the switch processing, and FIG. 6B is a flowchart showing an operation in the tone switch processing. When this processing is executed via Step SA2 (refer to FIG. 6) of the main flow described above, the CPU 10 executes the tone switch processing (refer to FIG. 6B) via Step SB1 shown in FIG. 6A.

When the tone switch processing is executed, the CPU 10 proceeds to Step SC1 shown in FIG. 6B, and judges whether the tone switch has been operated. When the tone switch has not been operated, since the judgment result is "NO", the CPU 10 ends this processing. When the tone switch has been operated, since the judgment result is "YES", the CPU 10 proceeds to Step SC2.

At Step SC2, the CPU 10 stores a tone number selected by the operation on the tone switch in a register TONE. Then, at subsequent Step SC3, the CPU 10 supplies an MIDI event (program change event) including the tone number stored in the register TONE to the sound source section 13, and ends the processing. Note that, in the sound source section 13, the CPU 10 emits a musical sound based on the waveform data of a tone specified by the given program change event.

When the tone switch processing is completed, the CPU 10 proceeds to Step SB2 shown in FIG. 6A, changes the current mode to an operation mode specified by a mode switching operation, and ends the processing. As such, in the switch processing, the CPU 10 gives an instruction regarding a tone number selected in accordance with a tone switching operation to the sound source section 13, and changes the current mode to an operation mode specified by a mode switching operation.

(3) Operation in Musical Performance Detection Processing

Figure 7:
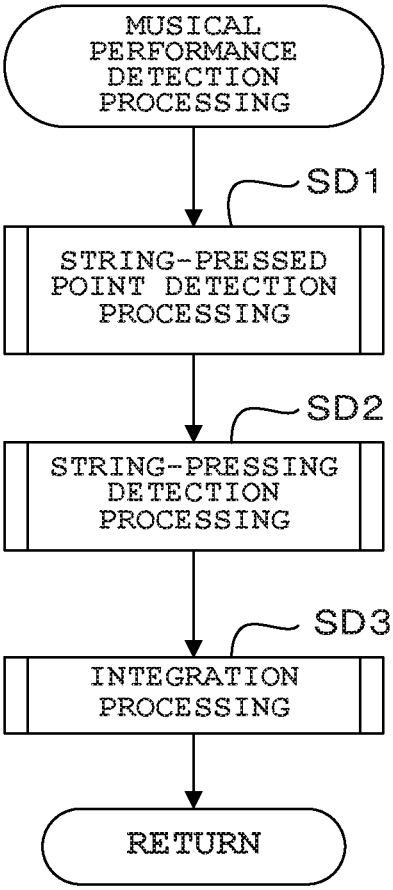
FIG. 7 is a flowchart showing an operation of musical performance detection processing which is executed by the CPU

Next, an operation in the musical performance detection processing is described with reference to FIG. 7. FIG. 7 is a flowchart showing an operation in the musical performance detection processing. When this processing is executed via Step SA3 (refer to FIG. 6) of the main flow described above, the CPU 10 executes the string-pressed point detection processing via Step SD1 shown in FIG. 7.

As described later, in the string-pressed point detection processing, the CPU 10 performs radio wave transmission with respect to each string 42 (the first string to the sixth string) one by one, and receives information as to which RFID tag 200 arranged between frets for each string performs data transmission in accordance with a string-pressing operation. When data transmitted as first identification information from one of the RFID tags 200 is received, the CPU 10 registers the highest sound (or position number) of a string that is a current detection target in a string-pressing register as a string-pressed point based on string-pressed point data acquired from a demodulated reception signal. Then, the CPU 10 determines as a string-pressed point, string-pressed point data having the maximum number of frets among string-pressed point data registered in the string-pressing register. When the reception is ended for an of the strings, the CPU 10 instructs the sound source section 13 to emit a musical sound of a pitch which is determined by the determined string-pressed point at a tone specified by an operation on the tone switch and a velocity (sound volume) calculated based on a detected vibration level when the vibration level of each string 42 (the first string to the sixth string) detected by the hexaphonic pickup 18 as second identification information is equal to or more than a certain level.

Next, at Step S02, the CPU 10 executes the string-plunking detection processing. As described later, in the string-plunking detection processing, when the vibration level of each string 42 (the first string to the sixth string) acquired based on the output of the hexaphonic pickup 18 becomes larger than the threshold value Th2, the CPU 10 turns on the normal trigger flag and extracts the pitch of the string vibration to determine a sound emission pitch. On the other hand, when the vibration level of each string 42 (the first string to the sixth string) becomes smaller than the predetermined threshold value Th3, the CPU 10 turns on the sound muting flag.

Then, at Step S03, the CPU 10 executes the integration processing. As described later, in the integration processing, the CPU 10 judges whether the preceding sound emission has been performed and, when judged that the preceding sound emission has been performed, adjusts the pitch of a musical sound that has been emitted by the preceding sound emission by the pitch (sound pitch) determined in the pitch extraction processing (refer to FIG. 13B). In addition, if the sound muting flag has been turned on in the muting detection processing (refer to FIG. 13C), the CPU 10 instructs the sound source section 13 to mute the sound. Conversely, when there is no preceding sound emission, if the normal trigger flag has been turned on in the normal trigger processing (refer to FIG. 13A), the CPU 10 gives an instruction for sound emission to the sound source section 13.

(4) Operation in String-Pressed Point Detection Processing

Figure 8:
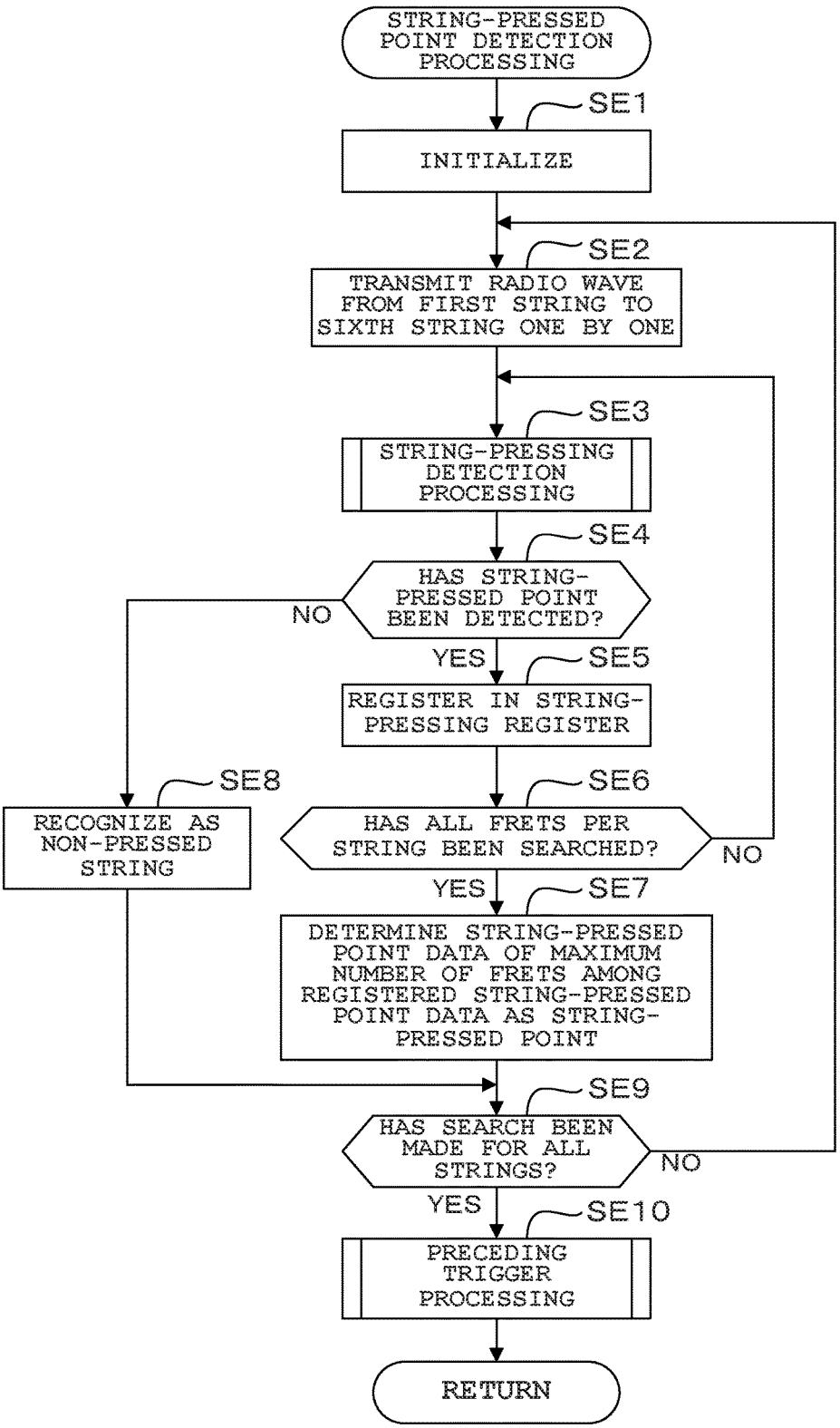
FIG. 8 is a flowchart showing an operation of string-pressed point detection processing which is executed by the CPU 10.

Next, an operation in the string pressed point detection processing is described with reference to FIG. 8. FIG. 8 is a flowchart showing an operation is the string-pressed point detection processing. When this processing is executed via Step SD1 (refer to FIG. 7) of the musical performance detection processing described above, the CPU 10 proceeds to Step SE1 shown in FIG. 8, and executes initialization to initialize a flag and register which are necessary in this processing. Subsequently, at Step SE2, the CPU 10 instructs the string input/output section 20 to perform radio wave transmission to each string 42 (the first string to the sixth string) one by one.

Next, at Step SE3, the CPU 10 executes the string-pressing detection processing. As described later, in the string-pressing detection processing, the CPU 10 acquires string-pressed point data (fret number) and string-pressing strength data from a reception signal acquired by on-data transmitted by an RFID tag 200 in response to a string-pressing operation being received and demodulated, and determines, as a string-pressed point, string-pressed point data (fret number) corresponding to the highest sound among string-pressed point data (fret number) acquired for a current detection target string. In addition, the CPU 10 turns on the string-pressed point detection flag. On the other hand, when the current detection target string has not been pressed and therefore string-pressed point data cannot be acquired, or in other words, when no string-pressed point can be determined, the CPU 10 turns off the string-pressed point detection flag.

Subsequently, at Step SE4, the CPU 10 judges whether a string-pressed point has been detected. That is, when the string-pressed point detection flag is ON, since the judgment result is "YES", the CPU 10 proceeds to Step SE5 and registers the string-pressed point data in the string-pressing register. Then, at Step SE6, the CPU 10 judges whether all the frets per string has been searched, or in other words, judges whether the reception of transmission data from the RFID tags 200 arranged between frets for the current detection target string has been completed.

When the reception has not been completed, since the judgment result of Step SE6 described above is "NO", the CPU 10 returns to Step SE3 described above. Hereinafter, the CPU 10 repeatedly executes the processing of Step SE3 to Step SE6 described above until the reception is completed. Then, when the reception of transmission data from the RFID tags 200 arranged between frets for the current detection target string is completed, since the judgment result of Step SE6 is "YES", the CPU 10 proceeds to Step SE7. At Step SE7, the CPU 10 determines, as a string-pressed point, string-pressed point data having the maximum number of frets among string-pressed point data registered in the string-pressing register, and then proceeds to subsequent Step SE9.

At Step SE4, when the string-pressed point detection flag is OFF, the judgment result of Step SE4 is "NO", and therefore the CPU 10 proceeds to Step SE8. At Step SE8, the CPU 10 recognizes the current detection target string as a non-pressed string on which a string pressing operation has not been performed, and proceeds to Step SE9. At Step SE9, the CPU 10 judges whether searching with respect to the first string to the sixth string has been completed. When searching with respect to the first string to the sixth string has not been completed, since the judgment result is "NO", the CPU 10 returns to Step SE2 described above. Hereafter, the CPU 10 repeatedly executes Step SE2 to Step SE9 until searching with respect to all the strings is completed.

Then, when searching with respect to all the strings is completed, since the judgment result of Step SE9 is "YES", the CPU 10 proceeds to Step SE10 At Step SE10, the CPU 10 ends the processing after executing, the preceding trigger processing. As described later, in the preceding trigger processing, when the vibration level of each string 42 (the first string to the sixth string) detected by the hexaphonic pickup 18 becomes a certain level or more, the CPU 10 instructs the sound source section 13 to emit the musical sound of a pitch determined by the determined string-pressed point at a tone specified by an operation on the tone switch and a velocity (sound volume) calculated based on the detected vibration level.

As such, in the string-pressed point detection processing, the CPU 10 receives first identification information from an RFID tag 200 arranged at a point where string-pressing is performed, whereby the string-pressed point can be detected. Upon receiving on transmitted from one of the RFID tags 200, the CPU 10 registers, as a string-pressed point, the highest sound (or position number) of a current detection target string in the string-pressing register, based on string-pressed point data acquired from a demodulated reception signal. Then, the CPU 10 determines, as a string-pressed point, string-pressed point data having the maximum number of frets among string-pressed point data registered in the string-pressing register. When the reception is completed for all the strings, the CPU 10 instructs the sound source section 13 to emit the musical sound of a pitch determined by the determined string-pressed point at a tone specified by an operation on the tone switch and a velocity (sound volume) calculated based on a detected vibration level when a vibration level serving as information regarding a plunked state which is second identification information of each string 42 (the first string to the sixth string) detected by the hexaphonic pickup 18 is a certain level or more.

(5) Operation in String-Pressing Detection Processing

Figure 9:
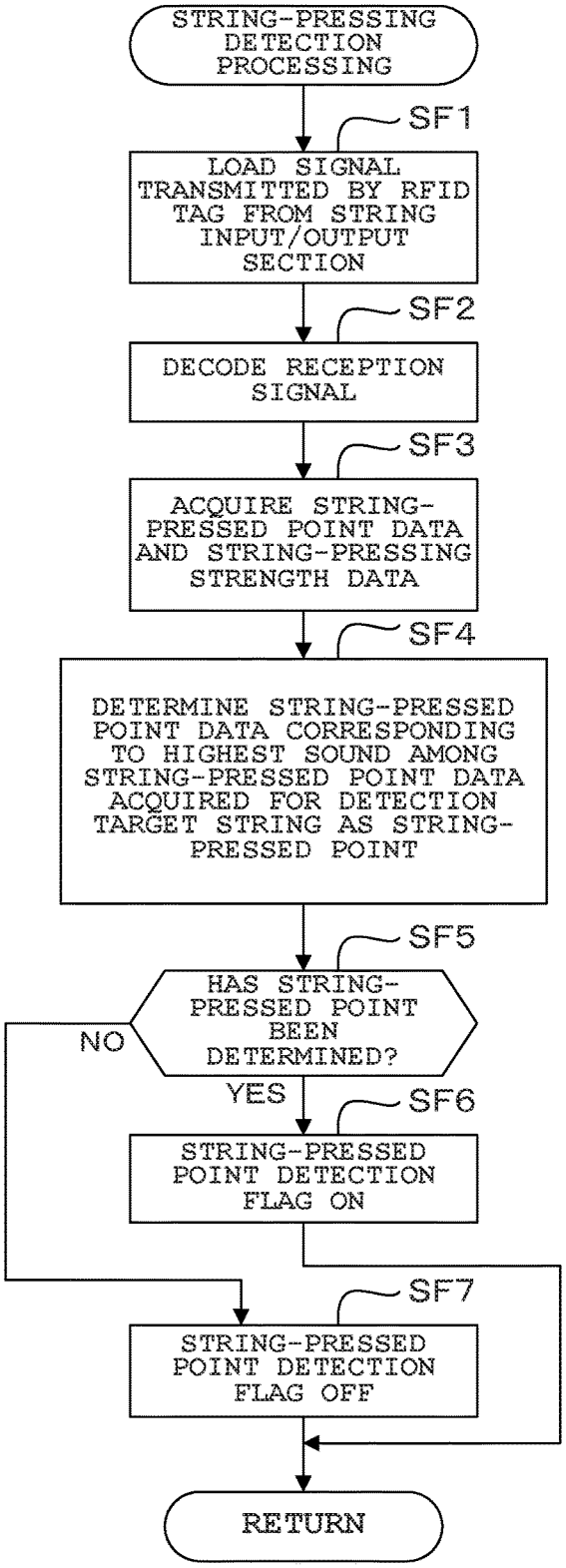
FIG. 9 is a flowchart showing an operation of string-pressing detection processing which is executed by the CPU 10.

Next, an operation in the string-pressing detection processing is described with reference to FIG. 9. FIG. 9 is a flowchart showing an operation in the string-pressing detection processing. When this processing is executed via Step SE3 (refer to FIG. 8) of the string-pressed point detection processing described above, the CPU 10 proceeds to Step SF1 in FIG. 9, and loads a reception signal (received on-data) from the string input/output section 20, and decodes the loaded reception signal at subsequent Step SF2. That is, the CPU 10 extracts "string-pressing flag", "received radio wave field intensity" and "fret number" included in the reception signal.

Next, at Step SF3, the CPU 10 acquires the "fret number" extracted at Step SF2 as string-pressed point data and also acquires the "received radio wave field intensity" extracted in Step SF2 as string-pressing strength data indicating a string-pressing strength. Then, at Step SF4, the CPU 10 determines, as a string-pressed point, string-pressed point data (fret number) corresponding to the highest sound among the string-pressed point data (fret number) acquired for the current detection target string.

Next, at Step SF5, the CPU 10 judges whether a string-pressed point has been determined based on the acquired string-pressed point data. When judged that a string-pressed point has been determined, since the judgment result is "YES" the CPU 10 proceeds to Step SF6, turns on the string-pressed point detection flag, and ends the processing. On the other hand, when no string-pressed point has been determined, since the judgment result is "NO", the CPU 10 proceeds to Step SF7, turns off the string-pressed point detection flag, and ends the processing.

As described above, in the string-pressing detection processing, the CPU 10 acquires string-pressed point data and string-pressing strength data from a reception signal acquired by on-data transmitted from an RFID tag 200 in response to a string-pressing operation being received and demodulated, and determines, as a string-pressed point, string-pressed point data (fret number) corresponding to the highest sound among the string-pressed point data (fret number) acquired for the current detection target string, and turns on the string-pressed point detection flag. On the other hand, when the current detection target string has not been pressed and therefore string-pressed point data cannot be acquired, or in other words, when no string-pressed point is determined, the CPU 10 turns off the string-pressed point detection flag.

(6) Operation in Preceding Trigger Processing

Figure 10:
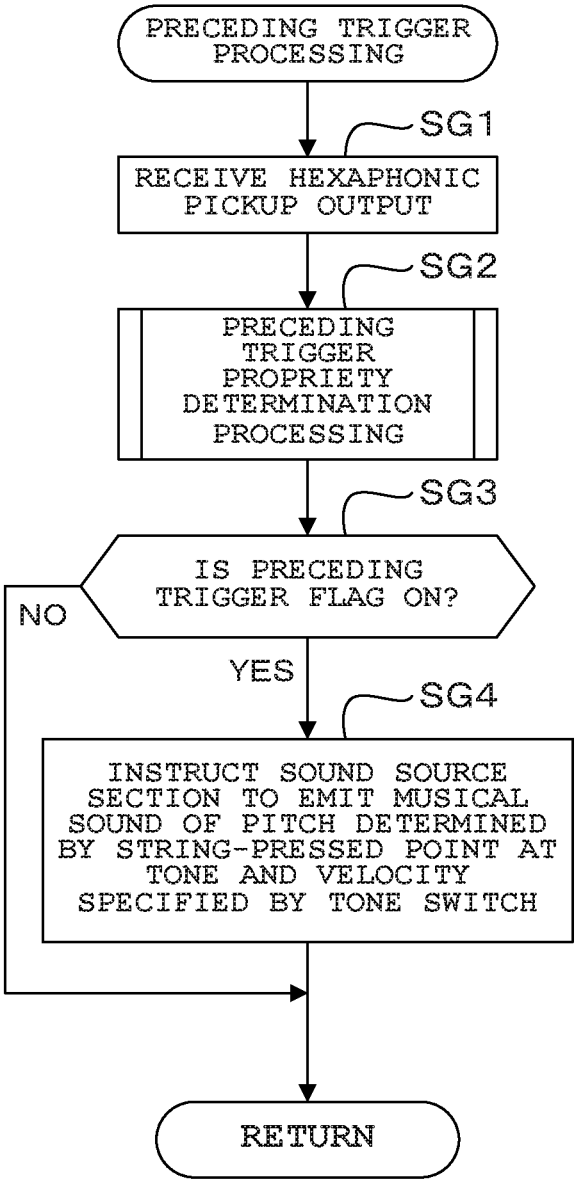
FIG. 10 is a flowchart showing an operation of preceding trigger processing which is executed by the CPU 10.
Figure 11:
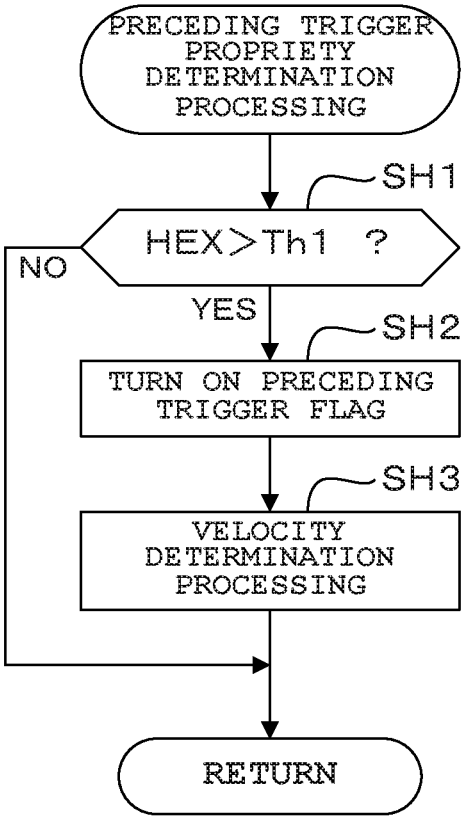
FIG. 11 is a flowchart showing an operation of preceding trigger propriety determination processing which is executed by the CPU 10.

Next, an operation in the preceding trigger processing is described with reference to FIG. 10 to FIG. 11. FIG. 10 is a flowchart showing an operation in the preceding trigger processing, and FIG. 11 is a flowchart showing an operation in the preceding trigger propriety determination processing. When the processing is executed via Step SE10 (refer to FIG. 8) of the string-pressed point detection processing described above, the CPU 10 proceeds to Step SG1 shown in FIG. 10, and acquires the vibration level of each string 42 (the first string to the sixth string) based on an output of the hexaphonic pickup 18.

Then, the CPU 10 executes the preceding trigger propriety determination processing via Step SG2, proceeds to Step SH1 shown in FIG. 11, and judges whether the vibration level of each string 42 (the first string to the sixth string) acquired at Step SG1 is larger than a predetermined threshold value Th1. When the vibration level of each string 42 (the first string to the sixth string) is smaller than the threshold value Th1, since the judgment result is "NO", the CPU 10 ends the processing. When the vibration level of each string 42 (the first string to the sixth string) is larger than threshold value Th1, since the judgment result is "YES", the CPU 10 proceeds to Step SH2. At Step SH2, the CPU 10 turns on a preceding trigger flag and, at subsequent Step SH3, executes velocity determination processing for calculating the velocity based on changes in a plurality of vibration levels sampled before the vibration level exceeds the threshold value Th1.

As such, in the preceding trigger propriety determination processing, when the vibration level of each string 42 (the first string to the sixth string) detected by the hexaphonic pickup 18 becomes a certain level or more, the CPU 10 turns on the preceding trigger flag, and determines the velocity based on changes in a plurality of vibration levels sampled before the vibration level exceeds the threshold value Th1.

Then, when the preceding trigger propriety determination processing is completed, the CPU 10 proceeds to Step SG3 shown in FIG. 10, and judges whether the preceding trigger flag is ON. When the preceding trigger flag is OFF, or in other words, when the vibration level of each string 42 (the first string to the sixth string) detected by the hexaphonic pickup 18 has not reached a certain level, the judgment result is "NO" and therefore the CPU 10 ends the processing.

On the other hand, when the vibration level of each string 42 (the first string to the sixth string) detected by the hexaphonic pickup 18 has reached a certain level or more and the preceding trigger flag is ON, the judgment result of Step SG3 described above is "YES" and therefore the CPU 10 proceeds to Step SG4. At Step SG4, the CPU 10 provides the sound source section 13 with a note-on event instructing to emit the musical sound of a pitch determined by a determined string-pressed point at a tone specified by an operation on the tone switch and the velocity (sound volume) calculated at the Step SH3 described above, and ends the processing.

As described above, in the preceding trigger processing, when the vibration level of each string 42 (the first string to the sixth string) detected by the hexaphonic pickup 18 becomes a certain level or more, the CPU 10 instructs the sound source section 13 to emit the musical sound of a pitch determined by a determined string-pressed point at a tone specified by an operation on the tone switch and a velocity (sound volume) calculated based on the detected vibration level.

(7) Operation in String-Plunking Detection Processing

Figure 12:
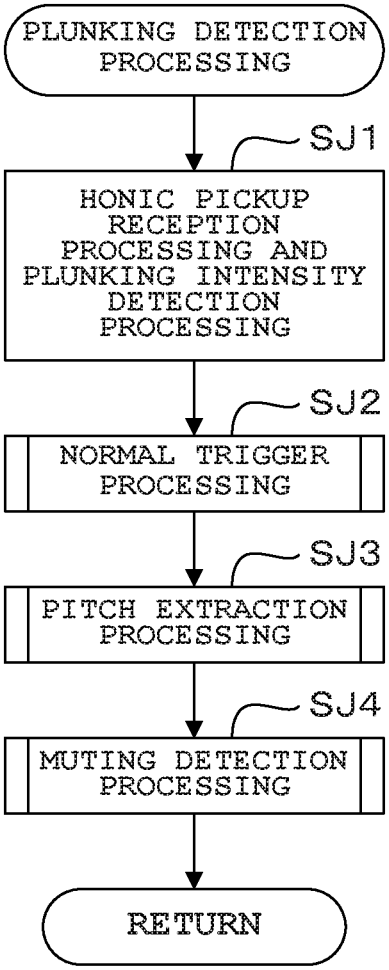
FIG. 12 is a flowchart showing an operation of string-plunking detection processing which is executed by the CPU 10.
Figure 13A:
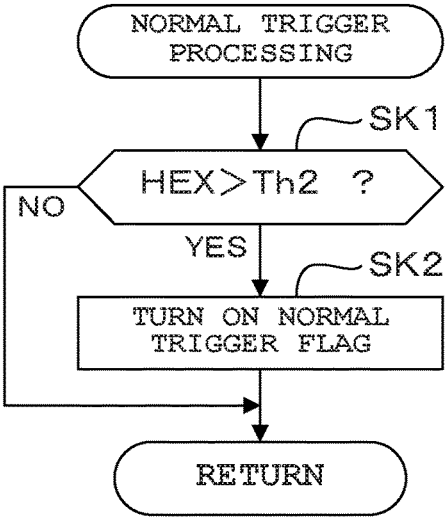
FIG. 13A to FIG. 13C are flowcharts showing an operation of normal trigger processing, an operation of pitch extraction processing and an operation of muting detection processing which are executed by the CPU 10.
Figure 13B:
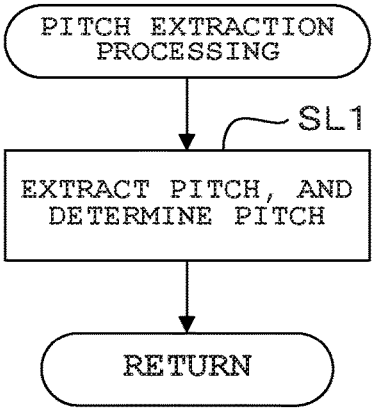
Figure 13C:
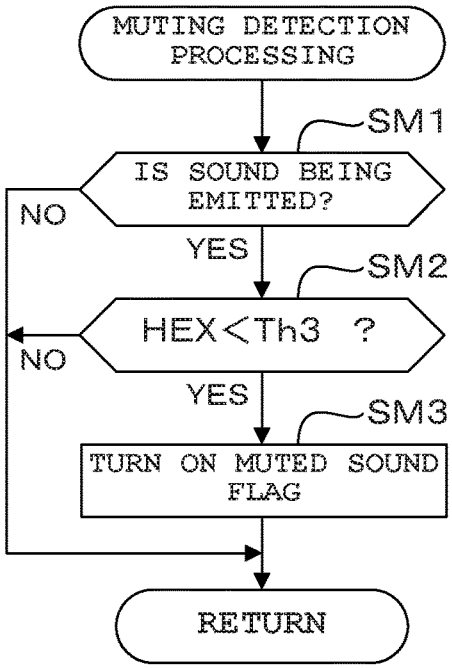

Next, an operation in the string-plunking detection processing is described with reference to FIG. 12 to FIG. 13C. In the string-plunking detection processing, second identification information regarding a plunked string is detected. FIG. 12 is a flowchart showing an operation in the string-plunking detection processing. FIG. 13A is a flowchart showing an operation in the normal trigger processing, FIG. 13B is a flowchart showing an operation in the pitch extraction processing, and FIG. 13C is a flowchart showing an operation in the muting detection processing.

When this processing is executed via Step SD2 (refer to FIG. 7) of the musical performance detection processing described above, the CPU 10 proceeds to Step SJ1 shown in FIG. 12, and acquires the vibration level of each string 42 (the first string to the sixth string) based on an output of the hexaphonic pickup 18. Subsequently, the CPU 10 executes the normal trigger processing via Step SJ2.

When the normal trigger processing is executed, the CPU 10 proceeds to Step SK1 shown in FIG. 13A, and judges whether the vibration level of each string 42 (the first string to the sixth string) acquired at Step SJ1 described above is larger than the predetermined threshold value Th2. When the vibration level of each string 42 (the first string to the sixth string) is smaller than the predetermined threshold value Th2, since the judgment result is "NO", the CPU 10 ends the processing. When the vibration level of each string 42 (the first string to the sixth string) is larger than the threshold value Th2, since the judgment result is "YES", the CPU 10 proceeds to Step SK2, turns on the normal trigger flag, and ends the processing.

When the normal trigger processing is completed, the CPU 10 executes the pitch extraction processing via Step SJ3 shown in FIG. 12. When the pitch extraction processing is executed, the CPU 10 proceeds to Step SL1 shown in FIG. 135, and performs publicly known pitch extraction for calculating a pitch based on the vibration frequency of a string, and determines the sound emission pitch.

Then, when the pitch extraction processing is completed, the CPU 10 executes the muting detection processing via Step SJ4 shown in FIG. 12. When the muting detection processing is executed, the CPU 10 proceeds to Step SM1 shown in FIG. 13C, and judges whether sound emission is being performed. When no sound emission is being performed, since the judgment result is "NO", the CPU 10 ends the processing. When sound emission is being performed, since the judgment result is "YES", the CPU 10 proceeds to Step SM2.

At Step SM2, the CPU 10 judges whether the vibration level of each string 42 (the first string to the sixth string) acquired at Step SJ1 described above (refer to FIG. 12) is smaller than the predetermined threshold value Th3. When the vibration level of each string 42 (the first string to the sixth string) is equal to or more than the threshold value Th3, since the judgment result is "NO", the CPU 10 ends the processing. When the vibration level of each string 42 (the first string to the sixth string) is smaller than the threshold value Th3, since the judgment result is "YES", the CPU 10 proceeds to Step SM3, turns on the sound muting flag, and ends the processing.

As described above, in the string-plunking detection processing, when the vibration level of each string 42 (the first string to the sixth string) acquired based on an output of the hexaphonic pickup 18 becomes larger than the threshold value Th2, the CPU 10 turns on the normal trigger flag, and extracts the pitch of the string vibration to determine the sound emission pitch. On the other hand, when the vibration level of each string 42 (the first string to the sixth string) is smaller than the predetermined threshold value Th3, the CPU 10 turns on the sound muting flag.

(8) Operation in Integration Processing

Figure 14:
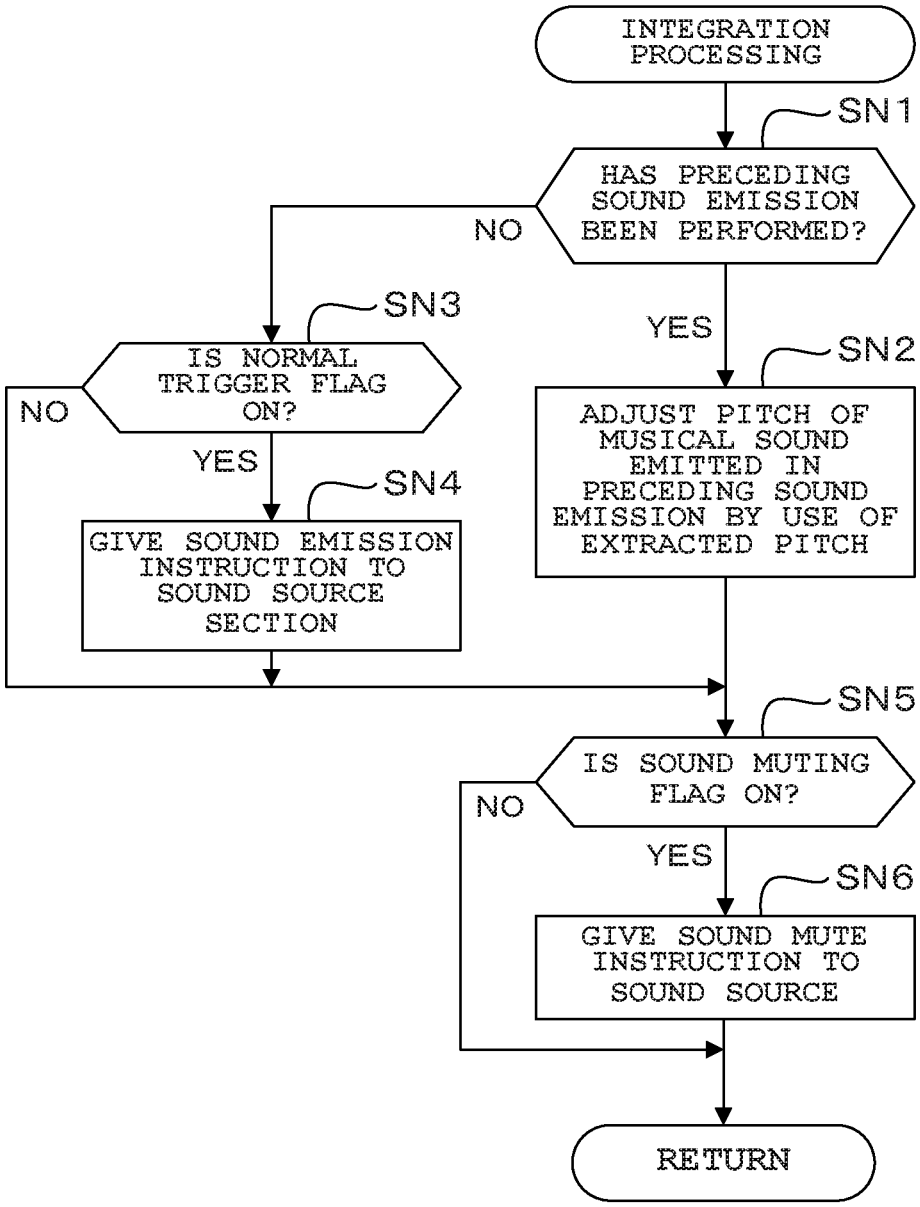
FIG. 14 is a flowchart showing an operation of integration processing which is executed by the CPU 10.

Next, an operation in the integration processing will be described with reference to FIG. 14. FIG. 14 is a flowchart showing an operation in the integration processing. When the present processing is executed via Step SD3 (refer to FIG. 7) of the musical performance detection processing described above, the CPU 10 proceeds to Step SN1 shown in FIG. 14, and judges whether the preceding sound emission has been performed, or in other words, judges whether a sound emission instruction has been given to the sound source section 13 in the preceding trigger processing described above (refer to FIG. 10).

When judged that the preceding sound emission has been performed, since the judgment result of Step SN1 described above is "YES", the CPU 10 proceeds to Step SN2. At Step SN2, the CPU 10 adjust the pitch of the musical sound emitted by the preceding sound emission to a pitch (sound pitch) extracted by the pitch extraction processing described above (refer to FIG. 13B), and then proceeds to Step SN5.

On the other hand, when there is no preceding sound emission, since the judgment result of Step SN1 described above is "NO", the CPU 10 proceeds to Step SN3. At Step SN3, the CPU 10 judges whether the normal trigger flag has been turned on in the normal trigger processing described above (refer to FIG. 13A). When judged that the normal trigger flag has not been turned on, since the judgment result is "NO", the CPU 10 proceeds to Step SN5.

Conversely, when the normal trigger flag is ON, since the judgment result of Step SN3 is "YES", the CPU 10 proceeds to Step SN4. At Step SN4, after giving a sound emission instruction to the sound source section 13, the CPU 10 proceeds to Step SN5. At Step SN5, the CPU 10 judges whether the sound muting flag has been turned on in the muting detection processing described above (refer to FIG. 13C). When the sound muting flag is OFF, since the judgment result is "NO", the CPU 10 ends the processing. When the sound muting flag is ON, since the judgment result is "YES", the CPU 10 proceeds to Step SN6, gives a sound mute instruction to the sound source section 13, and ends the processing.

As described above, in the integration processing, the CPU 10 judges whether the preceding sound emission has been performed and, when the preceding sound emission has been performed, adjusts the pitch of a musical sound emitted by the preceding sound emission by a pitch (sound pitch) determined by the pitch extraction processing (refer to FIG. 13B). In addition, when the sound muting flag has been turned on in the muting detection processing (refer to FIG. 13C), the CPU 10 instructs the sound source section 13 to mute the sound. On the other hand, when there is no preceding sound emission and the normal trigger flag has been turned on in the normal trigger processing (refer to FIG. 13A), the CPU 10 give a sound emission instruction to the sound source section 13.

(9) Operation in RFID Tag Processing

Figure 15:
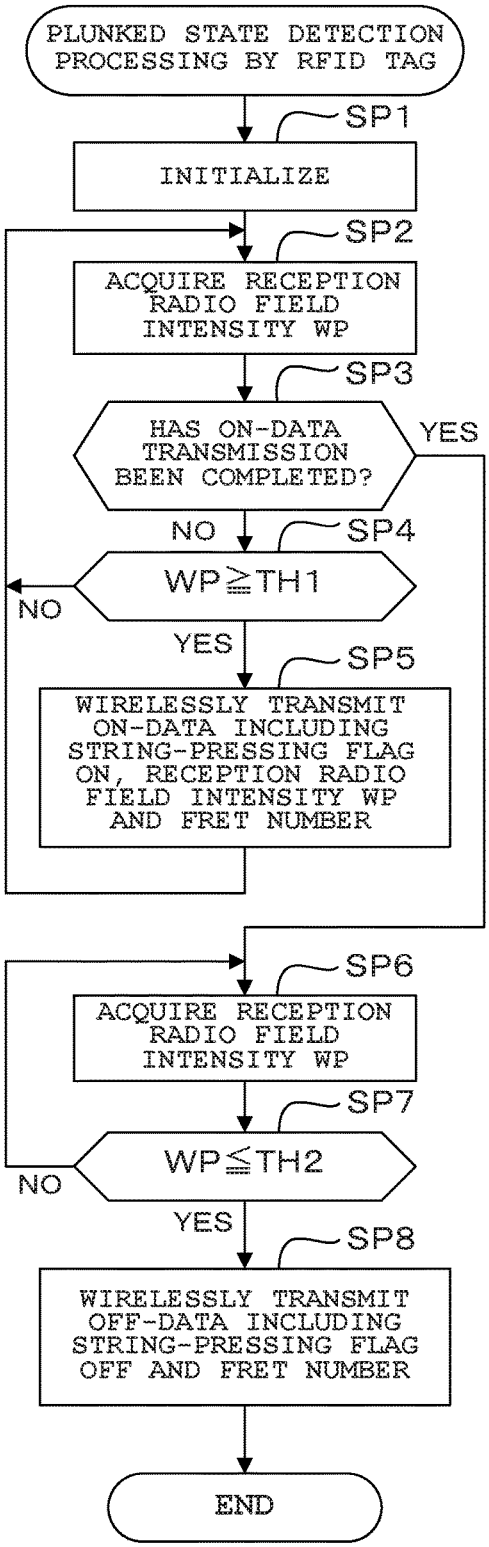
FIG. 15 is a flowchart showing an operation of RFID tag processing which is executed by the RFID tag 200.

Next, an operation in the REID tag processing that is executed by the RFID tags 200 is described with reference to FIG. 15 to FIG. 16. FIG. 15 is a flowchart showing an operation in the RFID tag processing, and FIG. 16 is a diagram for describing an operation of the RFID tags 200.

Figure 16:
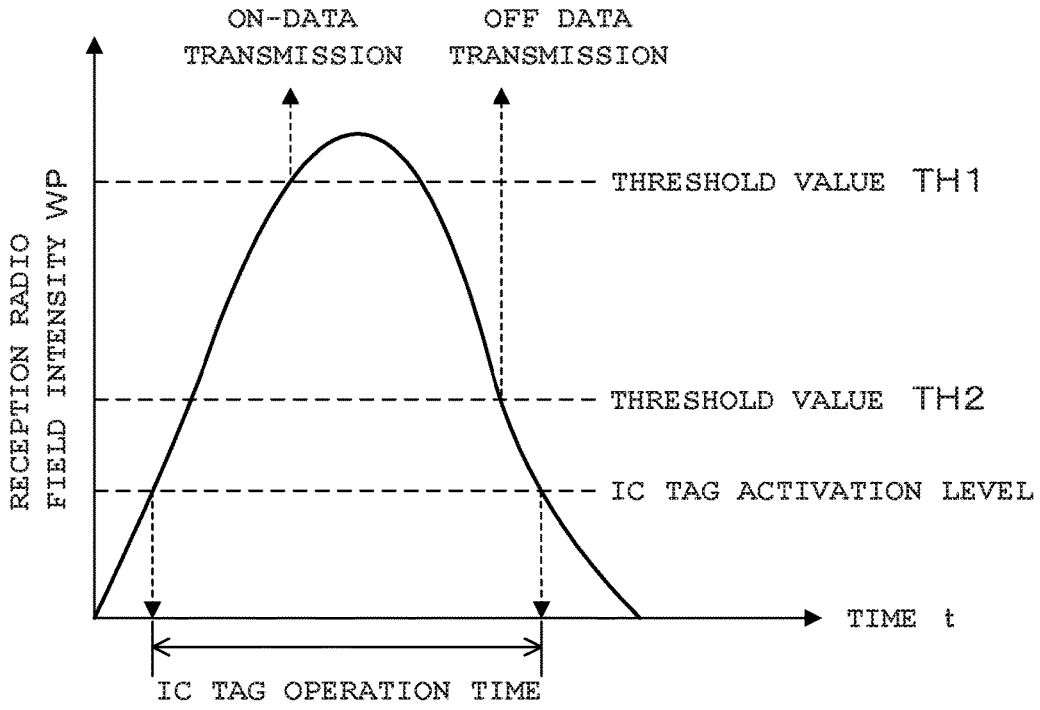
FIG. 16 is a diagram for describing an operation of the RFID tag 200.

In an RFID tag 200 where data transmission is performed by the publicly known radio wave type passive system, the built-in chip CP is activated by electrical power acquired by receiving a radio wave transmitted from a string 42 which functions as an antenna when it bends in response to a user's string-pressing operation and comes close to the REID tag 200 as shown in FIG. 16, whereby the RFID tag processing shown in FIG. 15 is executed.

When the RFID tag processing is executed, the RFID tag 200 performs processing of Step SP1 in FIG. 15 to execute initialization for initializing various registers and flags. Next, at Step SP2, the CPU of the RFID tag 200 acquires reception radio field intensity WP. Then, at subsequent Step SP3, the CPU judges whether the transmission of on-data has been completed. The on-data herein is data that is transmitted when a string 42 comes close to the RFID tag 200 in response to a string-pressing operation.

When no on-data has been transmitted, since the judgment result is "NO", the CPU proceeds to Step SP4. At Step SP4, the CPU judges whether the reception radio field intensity WP is equal to or more than a threshold value TH1 (refer to FIG. 16). When the reception radio field intensity WP has not reached the threshold value TH1 or more, since the judgment result is "NO", the CPU returns to Step SP2 described above, and acquires the reception radio field intensity WP again.

Then, for example, when the string 42 comes close to the RFID tag 200 by the string-pressing operation and the reception radio field intensity WP reaches the threshold value TH1 or more, since the judgment result of Step SP4 is "YES", the CPU proceeds to Step SP5. At Step SP5, the CPU wirelessly transmits on-data including "string-pressing flag ON", "reception radio field intensity WP" and its own "fret number". Note that the on-data wirelessly transmitted as described above is received by the string-pressing detection processing (refer to FIG. 9) described above.

When the transmission of the on-data is completed, the CPU returns to Step SP2 described above. Then, at Step SP3, the CPU judges again whether on-data transmission has been completed. Then, when judged that on-data transmission has been completed, since the judgment result of Step SP3 is "YES", the CPU proceeds to Step SP6. At Steps SP6 and SP7, the CPU stands by until the reception radio field intensity WP reaches a value equal to or lower than a threshold value TH2 (refer to FIG. 16). Then, when the reception radio field intensity WP reaches a value equal to or lower than the threshold value TH2, since the judgment result of Step SP7 is "YES", the CPU proceeds to Step SP8, wirelessly transmits off-data including "string-pressing flag OFF" and its own "fret number", and ends the processing.

As described above, in the present embodiment, the RFID tags 200 where wiring is not necessary are arranged between frets 43 for each string 42 (the first string to the sixth string), in the back surface of the fingerboard 41 in the neck portion 40. As a result, a problem of the conventional technology where an area occupied by a wiring board increases and the strength of the neck portion cannot be sufficiently maintained is solved, whereby the neck strength is maintained.

Also, when a string 42 comes close to an RFID tag 200 in response to a user's string-pressing operation, the RFID tag 200 wirelessly transmits on-data including at least its own "fret number (string-pressed point)" by using electrical power acquired by receiving a radio wave transmitted from the string 42 that functions as an antenna, and the main body 30 (electronic section 33) side receives it by the pressed string 42 functioning as the antenna. That is, because of the configuration where a string-pressed point is detected by non-contact detection, string-pressing detection can be performed without lowering the reliability of the detection operation due to a poor contact as in the conventional technology.

In the string-pressing detection processing in the above-described embodiment, string-pressed point data (fret number) corresponding to a highest sound among string-pressed point data (fret number) acquired for a current detection target string is determined as a string-pressed point. However, a configuration may be adopted in which string-pressed point data (fret number) corresponding to a highest sound among string-pressed point data (fret number) corresponding to string-pressing strength data no less than a predetermined value acquired for a current detection target string is determined as a string-pressed point.

Also, in the above-described embodiment, when a string 42 bent in response to a string-pressing operation comes close to an REID tag 200, on-data including string-pressed point data and string-pressing strength data is transmitted from the REID tag 200. Here, by performing musical sound control for changing the pitch and tone of a musical sound to be generated based on the string-pressing strength data included in the on-data, it is possible to simulate the sound emission process of a stringed musical instrument such as a guitar.

While the present invention has been described with reference to the preferred embodiments, it is intended that the invention be not limited by any of the details of the description therein but includes all the embodiments which fall within the scope of the appended claims.

What is claimed is:

1. An electronic stringed musical instrument comprising:

a plurality of strings which are tightened above a fingerboard section provided with a plurality of frets;

a plurality of Radio-Frequency Identification (RFID) tags each of which is arranged between frets;

a string-picking detection section which detects picked states of the plurality of strings; and a processing section which performs sound emission instruction processing for instructing a sound source to emit a musical sound of a pitch determined based on first identification information transmitted from an RFID tag and second identification information including information regarding the picked states of the plurality of strings detected by the string-picking detection section, wherein the first identification information includes information regarding a pressed state of a pressed string, the first identification information being transmitted from the RFID tag when the pressed string comes close to the RFID tag such that a radio field intensity in the RFID tag exceeds a first threshold value, and the radio field intensity being proportional to a distance between the pressed string and the RFID tag.

2. The electronic stringed musical instrument according to claim 1, wherein the processing section performs transmission processing for transmitting a radio wave from each of the plurality of strings, and wherein the RFID tag receives the radio wave by the pressed string being pressed, and transmits the first identification information.

3. The electronic stringed musical instrument according to claim 1, wherein the processing section receives the first identification information transmitted from the RFID tag.

4. The electronic stringed musical instrument according to claim 1, wherein the RFID tags are arranged between frets, and each of the RFID tags corresponds to a respective one of the plurality of strings.

5. The electronic stringed musical instrument according to claim 1, wherein the string-picking detection section further detects a string-picking intensity, and wherein the processing section in the sound emission instruction processing further performs processing for giving to the sound source an instruction regarding a sound volume of the musical sound for which a sound emission instruction has been given based on the detected string-picking intensity.

6. The electronic stringed musical instrument according to claim 1, wherein the RFID tag is configured to receive a radio wave transmitted from the pressed string, when the pressed string is pressed.

7. The electronic stringed musical instrument according to claim 4, wherein the processing section judges, for each of the plurality of RFID tags, whether a radio wave transmitted from a corresponding one of the plurality of strings has been received, and performs processing for detecting a string-pressed point of each of the plurality of strings based on RFID tags that have received radio waves.

8. The electronic stringed musical instrument according to claim 4, wherein the processing section judges that the pressed string has been pressed when the radio field intensity of a received radio wave in the RFID tag exceeds the first threshold value, and judges that the pressed string has been released from string-pressing when the radio field intensity of the received radio wave in the RFID tag becomes less than a second threshold value.

9. A musical sound generation instruction method for an electronic stringed musical instrument having a plurality of strings which are tightened above a fingerboard section provided with a plurality of frets, a plurality of Radio-Frequency Identification (RFID) tags each of which is arranged between frets, a string-picking detection section which detects picked states of the plurality of strings, and a processing section, the method being executed under control of the processing section, and the method comprising:

instructing a sound source to emit a musical sound of a pitch determined based on first identification information transmitted from an RFID tag and second identification information including information regarding picked states of the plurality of strings detected by the string-picking detection section.

10. A non-transitory computer-readable storage medium having stored thereon a program that is executable by a computer in an electronic stringed musical instrument having a plurality of strings which are tightened above a fingerboard section provided with a plurality of frets, a plurality of Radio-Frequency Identification (RFID) tags each of which is arranged between frets, and a string-picking detection section which detects picked states of the plurality of strings, the program being executable by the computer to perform functions comprising:

instructing a sound source to emit a musical sound of a pitch determined based on first identification information transmitted from an RFID tag and second identification information including information regarding picked states of the plurality of strings detected by the string-picking detection section.

11. The electronic stringed musical instrument according to claim 3, wherein each of the plurality of strings is configured to function as an antenna, and the RFID tag transmits the first identification information to the processing section via the pressed string that functions as an antenna.

12. The method according to claim 9, wherein the first identification information includes information regarding a pressed state of a pressed string, the first identification information being transmitted from the RFID tag when the pressed string comes close to the RFID tag such that a radio field intensity in the RFID tag exceeds a first threshold value, and the radio field intensity being proportional to a distance between the pressed string and the RFID tag.

13. The non-transitory computer-readable storage medium according to claim 10, wherein the first identification information includes information regarding a pressed state of a pressed string, the first identification information being transmitted from the RFID tag when the pressed string comes close to the RFID tag such that a radio field intensity in the RFID tag exceeds a first threshold value, and the radio field intensity being proportional to a distance between the pressed string and the RFID tag.

* * * * *